US008400878B2

(12) United States Patent
Lindner et al.

(10) Patent No.: US 8,400,878 B2
(45) Date of Patent: Mar. 19, 2013

(54) MOUNTING STRUCTURE FOR UNDERWATER ACOUSTIC ANTENNA WITH U-SHAPED SPRING ELEMENTS

(75) Inventors: Jürgen Lindner, Ganderkessee (DE); Dirk-Oliver Fogge, Twisringen (DE); Christoph Hoffmann, Ganderkessee (DE)

(73) Assignee: Atlas Elektronik GmbH, Bremen (DE)

( * ) Notice: Subject to any disclaimer, the term of this patent is extended or adjusted under 35 U.S.C. 154(b) by 284 days.

(21) Appl. No.: 12/766,336

(22) Filed: Apr. 23, 2010

(65) Prior Publication Data

US 2010/0271907 A1 Oct. 28, 2010

(30) Foreign Application Priority Data

Apr. 23, 2009 (DE) ..... 10 2009 018 624

(51) Int. Cl.
*B06B 1/06* (2006.01)

(52) U.S. Cl. ..... 367/151

(58) Field of Classification Search ..... 367/151, 367/173, 176; 248/638, 647, 674
See application file for complete search history.

(56) References Cited

U.S. PATENT DOCUMENTS

| | | | | |
|---|---|---|---|---|
| 5,274,978 | A * | 1/1994 | Perkonigg et al. | 52/547 |
| 6,856,580 | B2 * | 2/2005 | Eyries | 367/165 |
| 7,236,427 | B1 * | 6/2007 | Schroeder | 367/188 |
| 2008/0025149 | A1 * | 1/2008 | Snyder | 367/173 |

FOREIGN PATENT DOCUMENTS

| | | | |
|---|---|---|---|
| DE | 43 39 798 | A1 | 5/1995 |
| DE | 38 34 669 | | 7/1996 |
| DE | 10 2006 060 796 | | 6/2008 |
| DE | 20 2008 010 210 | | 10/2008 |
| RU | 2130402 | C1 | 5/1999 |
| RU | 2167499 | C2 | 5/2001 |
| RU | 2217885 | C2 | 11/2003 |
| WO | 2009062565 | A1 | 5/2009 |

* cited by examiner

*Primary Examiner* — Isam Alsomiri
*Assistant Examiner* — James Hulka
(74) *Attorney, Agent, or Firm* — Fitch, Even, Tabin & Flannery, LLP

(57) ABSTRACT

In the case of an electroacoustic underwater antenna, which has a reflector (11) and spring elements which fix the reflector (11) on an antenna mount (10), in particular on the hull of a submarine, in order to produce an underwater antenna which can be produced at low cost from only a small number of components, and in which the reflector (11) to which electroacoustic transducers are fitted is at an adequate distance from the antenna mount (10), is acoustically well decoupled from the antenna mount (10) and is largely resistant to shock loading, the spring elements have an upper and a lower resilient rocker (19, 20), wherein each rocker (19, 20) extends over the horizontal extent of the reflector (11) in the fitted position. Each rocker (19, 20) has a rear contact limb (192, 202), for making contact with and fixing on the antenna mount (10), and a front contact limb (191, 201), for making contact with and fixing on the reflector (11).

17 Claims, 4 Drawing Sheets

MOUNTING STRUCTURE FOR UNDERWATER ACOUSTIC ANTENNA WITH U-SHAPED SPRING ELEMENTS

CROSS-REFERENCE TO RELATED APPLICATION

The present application claims the priority of German Patent Application No. 10 2009 018 624.7, filed Apr. 23, 2009, the subject matter of which, in its entirety, is incorporated herein by reference.

BACKGROUND OF THE INVENTION

The invention relates to an electroacoustic underwater antenna having a reflector and having spring elements which fix the reflector on an antenna mount, in particular on a hull of a submarine, and act on the reflector close to its upper and lower longitudinal edges in the fitted position of the reflector.

A known linear underwater antenna (DE 38 34 669 A1) which is arranged on a hull of a submarine and is referred to as a flank array has a transducer arrangement, which is arranged at a distance from the hull and has a multiplicity of hydrophones which are at a distance from one another and are arranged horizontally in a row one behind the other along the hull when the underwater antenna is in the fitted position, and an insulating panel to provide a screening effect against sound emitted from the hull, which insulating panel is arranged behind the hydrophones in the sound incidence direction, is designed on the basis of the spring-and-mass principle and acts as poor sound reflector in the lower frequency range. The hydrophones are held on the insulating panel via a shell structure, and the insulating panel is attached by means of spring elements to a damping layer which absorbs bending waves and is connected to the hull. The transducer arrangement is mechanically protected by an envelope body which is attached to the hull. By having a streamlined design, the envelope body at the same time offers protection against flow noise. The acoustic characteristic impedance of the envelope body is approximately equal to that of the surrounding water, as a result of which the acoustic attenuation of sound passing through it and the reflection factor of the envelope body for incident sound waves are low. If the envelope body is in the form of a layer composite, as is known from DE 36 42 747 C2, this also prevents the emission of interference sound, which is caused by bending waves resulting from structure-borne sound and turbulence, from the envelope body to the transducer arrangement.

The invention is based on the object of designing a low-cost underwater antenna having only a small number of individual components, in particular for fitting to the hull of a submarine, in which the reflector to which the electronic transducer arrangement is fitted is at an adequate distance from the antenna mount, that is to say from the hull, is acoustically well decoupled from the hull and is largely resistant to shock loading.

SUMMARY OF THE INVENTION

The above object generally is achieved according to the present invention by an electroacoustic underwater antenna having a reflector and having spring elements which fix the reflector on an antenna mount, in particular on a hull of a submarine, and act on the reflector close to its upper and lower longitudinal edges in the fitted position of the reflector. The spring elements have an upper and a lower resilient rocker, and each rocker extends over the horizontal extent of the reflector in the fitted position and has a front contact limb, for making contact with and fixing on the reflector, and a rear contact limb, for making contact with and fixing on the antenna mount.

The electroacoustic underwater antenna according to the invention has the advantage that the two rockers, which each extend over the entire length of the reflector, result in a long distance to the reflector and good acoustic decoupling of the reflector from the antenna mount. The required spring constant of the rockers can easily be achieved by shape and material thickness. The impact energy of shockwaves striking the reflector is transmitted, distributed over an area via the rockers, to the antenna mount, as a result of which the antenna design is shock-proof. Because of the different designs of both rockers, the reflector is allowed to be aligned vertically on the hull of the submarine, with the antenna structure being sufficiently shock-resistant.

Expedient embodiments of the underwater antenna according to the invention, together with advantageous developments and refinements of the invention, are specified in the further claims.

According to one advantageous embodiment of the invention, the rockers are arranged such that the U-openings in the two rockers point away from one another. With this structural arrangement of the rockers, a more compact underwater antenna with smaller dimensions in the vertical direction is provided while the dimensions of the reflector are kept constant. Thus a normally intended envelope body can be designed with significantly smaller dimensions.

According to one advantageous embodiment of the invention, the intermediate space between the upper and lower rockers is filled by a buoyant body which on the one hand extends as far as the antenna mount and on the other hand ends at a distance in front of the reflector. If the buoyant body, which is preferably composed of a hard-foam core surrounded by an encapsulation compound, is appropriately designed, the underwater antenna is held in a largely neutrally buoyant manner under water. In addition, a certain amount of stiffening can be produced between the rockers, therefore affecting their spring characteristic, by the buoyant body being linked to the rear part of the two rockers.

According to one advantageous embodiment of the invention, the two rockers rest with their rear contact limbs on the antenna mount with the interposition of an elastic layer, which is preferably composed of rubber cork, and, with at least two elongated holes which are provided in each rear contact limb, each clasp a cylindrical carrier which projects from the antenna mount. A threaded bolt which is firmly clamped on the antenna mount with a force fit by the rear contact limbs is screwed into each carrier. Lateral-force discs which are composed of glass-fibre-reinforced plastic and are placed largely without any play on the carriers are arranged between the bolt heads of the threaded bolts and the contact limbs. This physical fixing of the rockers to the antenna mount compensates for tolerances in the distance between the carriers which are used for attachment of a rocker, therefore making it easier to fit the rockers. Acoustic decoupling of the rockers from the antenna mount is improved in that an elastic disc, which is preferably composed of rubber cork, is also inserted between the lateral-force disc and a metallic conical spring washer which is pressed onto the lateral-force disc by the bolt head.

According to one advantageous embodiment of the invention, the reflector is fixed on the front contact limbs of the upper and lower rockers by means of plastic studs which are screwed to the contact limbs and are preferably composed of polyamide, and the reflector is firmly clamped resiliently to the plastic studs. Each plastic stud has a rear stud section, which rests on the front contact limb, and a front stud section, which is concentrically adjacent thereto and has a larger external diameter than the rear stud section. A threaded blind hole is introduced into each stud section from its end surface, wherein a screw, which passes through the front contact limb of the rocker, is screwed into the threaded blind hole in the rear stud section, and a screw which passes through a conical spring washer, which rests on the reflector, is screwed into the threaded blind hole in the front stud section. Since two separate threaded blind holes, which are introduced into the plastic studs, are provided and a continuous threaded hole has been dispensed with, the plastic stud is considerably more robust against lateral and shear forces.

According to one advantageous embodiment of the invention, an acoustically transparent envelope body is placed in front of the reflector, on its front face facing away from the antenna mount, and the envelope body is fixed to the upper and lower rockers. The envelope body is in this case preferably fixed via studs which are arranged on the rockers and to which the envelope body is clipped in an interlocking manner by a respective recess. A screw is screwed into the studs, and braces the envelope body on the rocker. In this case, each recess in the envelope body preferably has an associated coaxial cutout with a larger unobstructed diameter, and a clamping screw, which clasps the envelope body, is inserted into each cutout, through which the screw shank of the screw is passed. An elastic disc, which is pushed onto the studs and is preferably composed of rubber cork, ensures a certain amount of acoustic decoupling between the envelope body and the respective rocker.

The invention will be described in more detail in the following text with reference to exemplary embodiments which are illustrated in the drawing.

DETAILED DESCRIPTION OF THE INVENTION

Figure 1:
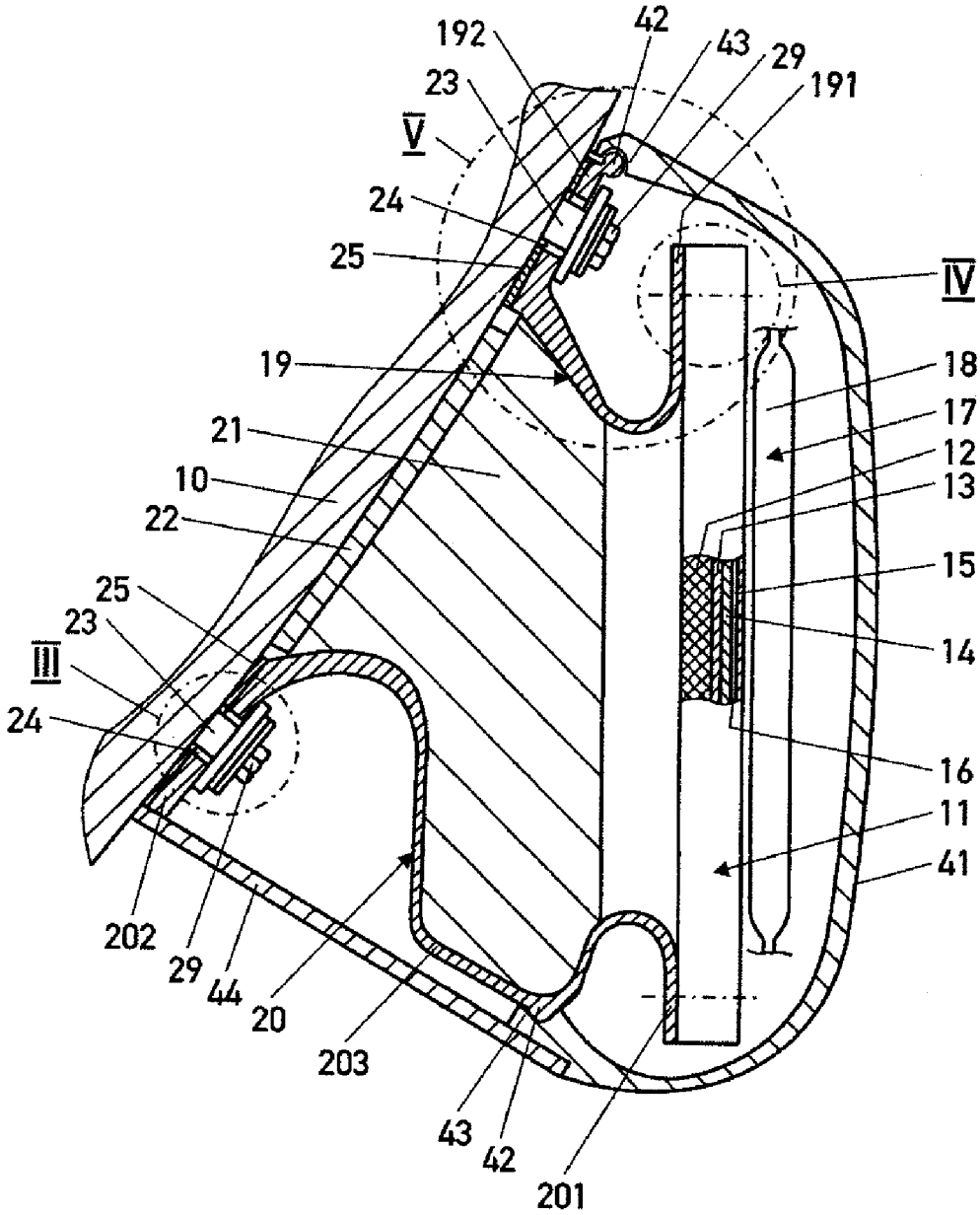
FIG. 1 shows a section through an electroacoustic underwater antenna mounted on an antenna mount.
Figure 2:
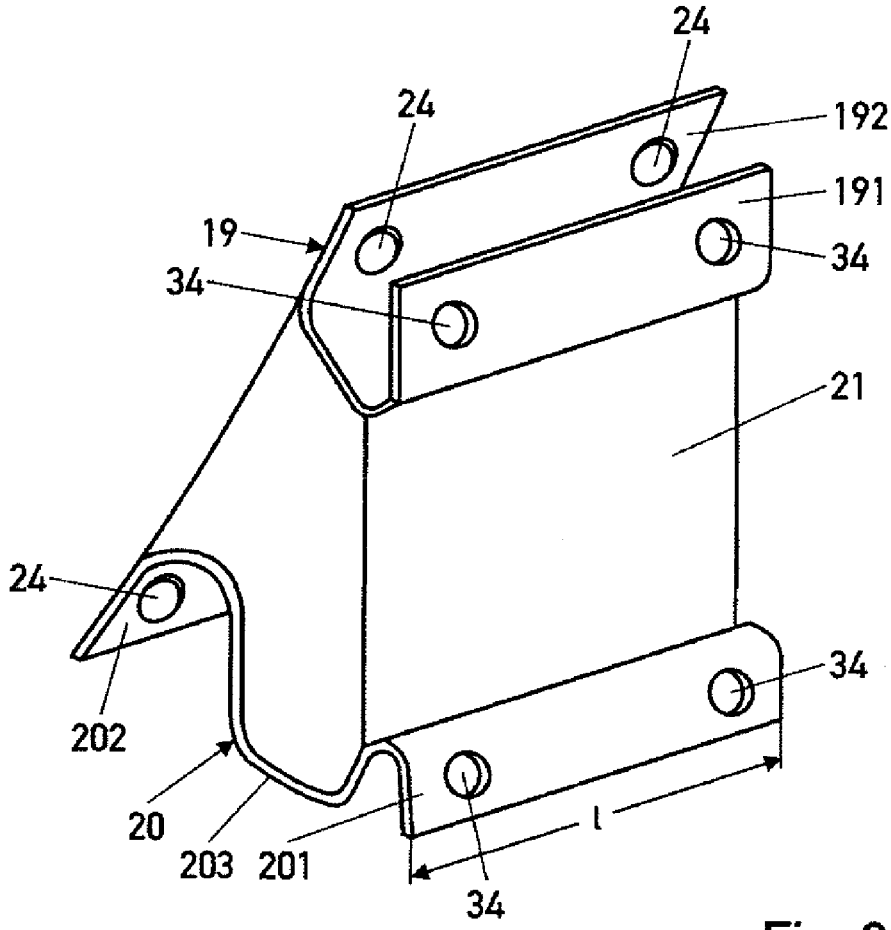
FIG. 2 shows a perspective view of the underwater antenna, removed from the antenna mount, in FIG. 1 with the envelope body and reflector removed.

The electroacoustic underwater antenna which is illustrated schematically in the form of a cross section in FIG. 1 is attached to an antenna mount 11, for example to the hull of a submarine. For production and fitting reasons, the underwater antenna has a horizontal length l (FIG. 2) which is restricted in the fitted position and, for example, is between one and two metres. A plurality of such underwater antennas, which are illustrated in the form of a cross section in FIG. 1, are arranged horizontally without any gaps in order to produce a flank antenna as is normally arranged on the port and starboard sides of a submarine.

The underwater antenna has a reflector 11 which is fixed in an acoustically decoupled manner to the antenna mount 10 via spring elements. The reflector 11 is in the form of a spring-and-mass system, in a known manner, and for example has a soft material panel 12 as a spring and a lead panel 13 as a mass, in conjunction with a composite placed in front of it in the sound incidence direction, composed of two thin aluminium panels 14, 15 with a layer 16 composed, for example, of rubber which is located in between and damps bending waves. A transducer arrangement 17 comprising a multiplicity of electroacoustic transducers, preferably hydrophones, is mounted in a known manner on the front face of the reflector 11, facing away from the antenna mount 10. In this case, a plurality of transducers, which are arranged vertically one beneath the other and are formed, for example, by small ceramic spheres are combined by embedding them in an acoustically transparent encapsulation compound to form a transducer stave 18. A plurality of staves 18 are arranged alongside one another, with a distance between them, over the length l of the underwater antenna. All the staves 18 are attached at the top and bottom to the reflector 11, although this is not illustrated separately in FIG. 1.

The reflector 11 is arranged a relatively long distance away from the antenna mount 10 by means of the spring elements, in order to reduce the structure-borne sound emitted from the antenna mount 10. In order to improve the resistance of the reflector attachment to shockwaves, the spring elements for this purpose have an upper resilient rocker 19 and a lower resilient rocker 20. The two rockers 19, 20 are produced from glass-fibre-reinforced plastic and have a shape and material thickness that produce the required spring constant. Each rocker 19, 20 has a horizontal length l (FIG. 2) in the fitted position which corresponds to the size of the reflector 11 in the horizontal direction. Each rocker 19, 20 has a front contact limb 191 and 201, respectively, for making contact with and fixing on the reflector 11, and a rear contact limb 192 and 202, respectively, for making contact with and fixing on the antenna mount 10. In this case, the upper rocker 19 has an approximately U-shaped profile, and the lower rocker 20 has a profile which is formed from two U-shaped end sections, which respectively contain the front and rear contact limbs 201 and 202, and an extended centre section 203, which connects them integrally. The two rockers 19, 20 are in this case arranged such that the U-openings in the two rockers 19, 20 point away from one another. The intermediate space between the upper rocker 19 and the lower rocker 20 is filled by a buoyant body 21 which on the one hand extends as far as the antenna amount 10 and on the other hand ends at a distance in front of the reflector 11. The buoyant body 21 rests on the antenna mount 10 with the interposition of an elastic film 22, for example composed of rubber cork. The distance between the buoyant body 21 and the reflector 11 is defined such that the base of the end section (which contains the front contact limbs 191 and 201) of the upper rocker 19 and of the lower rocker 20 is released from the buoyant body 21. The buoyant body 21, which is designed such that the weight of the underwater antenna is largely compensated for by the buoyancy produced by this body in the water, has a hard-foam core surrounded by a water-resistant encapsulation compound.

Figure 3:
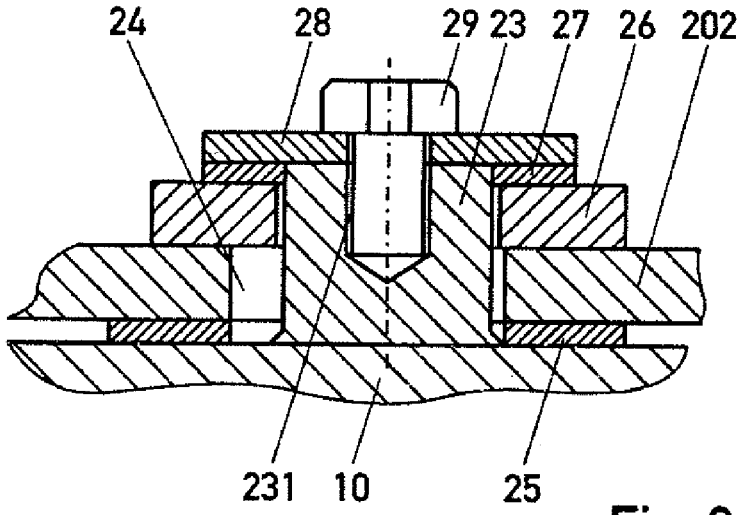
FIG. 3 shows an enlarged section illustration of the detail III in FIG. 1.

For each rocker 19, 20, the rocker 19, 20 is attached to the antenna mount 10 at at least two attachment points of the rear contact limbs 192 and 202. FIG. 3 shows an enlarged section view of the attachment points. The antennas mount 10 has so-called carriers 23, which are arranged at a distance from one another in the horizontal direction. Two rows of carriers 23 are in each case located vertically one above the other on the antenna mount 10. The expression carriers 23 means preferably cylindrical attachment stubs which project from the antenna mount 10, that is to say from the hull of the submarine and are each provided with a threaded hole 231. Each rear contact limb 192 or 202 of the upper rocker 19 and of the lower rocker 20, respectively contains at least two elongated holes 24 (FIG. 2), which are arranged at the same distance from one another as the carriers 23. In order to attach the rockers 19 and 20, the respective rear contact limb 192 or 202 is pushed with each of the elongated holes 24 over in each case one of the carriers 23, with an elastic layer 25, preferably composed of rubber cork, having previously been placed onto the antenna mount 10 around the carriers 23, on which layer the respective rear contact limbs 192 and 202 are supported in order to achieve a certain acoustic decoupling. The elongated holes 24 make it possible to compensate for distance tolerances between the carriers 23 on the antenna mount 10 on the one hand and the elongated holes 24 in the rockers 19, 20 on the other hand. A lateral-force disc 26 is then pushed radially, largely without any play, onto each carrier 23. An elastic disc 27, preferably composed of rubber cork, is placed onto each lateral-force disc 26, and a conical spring washer 28 composed of metal, preferably a steel washer, is pressed onto the elastic disc 27 by screwing a threaded bolt 29 into the threaded hole 231 in the carriers 23 until the conical spring washer 28 rests on the end surface of the carrier 23. Each rear contact limb 192 or 202 of the respective rockers 19, 20 is therefore attached to the antenna mount 10 with a force fit and in an acoustically decoupled manner.

The reflector 11 is fixed to the respective front contact limbs 191 and 201 of the upper rocker 19 and of the lower rocker 20 by means of plastic studs 30 which are screwed to the front contact limbs 191 and 201. The attachment of the reflector 11 to the front contact limb 191 of the upper rocker 19 is illustrated in the form of an enlarged detail in FIG. 4. The reflector 11 is also attached in the same way to the front contact limb 201 of the lower rocker 20. Each of the plastic studs 30, which are preferably composed of polyamide and, for example, are cylindrical, has a rear stud section 301, which rests on the front contact limb 191, and a stud section 302, which is integrally adjacent thereto coaxially, and whose external diameter is considerably smaller than the external diameter of the rear stud section 301. Respective threaded blind holes 31 and 32 are introduced into each respective stud section 301 and 302 from the end face. The screw shank 331 of a cap screw 33 is screwed into the threaded blind hole 31 in the rear stud section 301 and is passed through a corresponding through-hole 34 (FIG. 2) in the upper rocker 19. The respective front contact limbs 191 and 201 of the upper rocker 19 and lower rocker 20 have two such through-holes 34, which are arranged at the greatest possible distance from one another, such that two plastic studs 30 are in each case screwed to each front contact limb 191 and 201 and are at the maximum distance from one another on each rocker 19 and 20.

Figure 4:
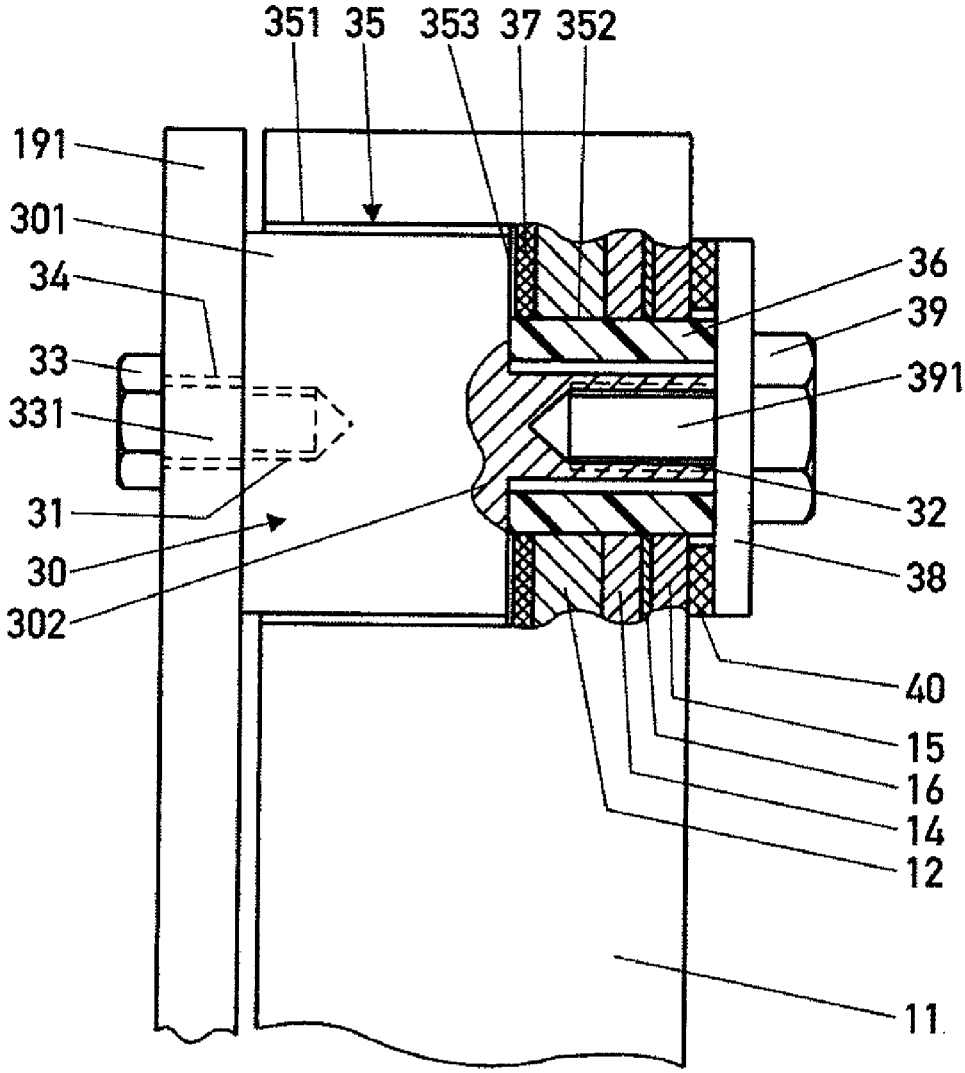
FIG. 4 shows an enlarged detail illustration of the detail IV in FIG. 1, partially sectioned.

Close to its corner points, the reflector 11 has a total of four stepped-diameter through-channels 35, via which the reflector 11 is placed on the plastic studs 30 and is attached to the plastic studs 30. FIG. 4 shows the detail of the attachment of the reflector 11 to the front contact limb 191 of the upper rocker 19, and this is applicable to all the attachment points of the reflector 11.

The through-channel 35 has a rear channel section 351 with a larger diameter, which clasps the rear stud section 301 of the plastic stud 30 with a small amount of play, and a front channel section 352, whose diameter in contrast is smaller but whose unobstructed diameter is considerably greater than the external diameter of the front stud section 302. A radial shoulder 353 is formed between the rear channel section 351 and the front channel section 352, by means of which the reflector 11 rests, with the interposition of an elastic disc 37, on the annular end surface of the rear stud section 301 surrounding the front stud section 302. A resilient sleeve 36 is pushed in between the front stud section 302 and the front channel section 352 and is clamped in axially between the end surface of the rear stud section 301 and a metallic conical spring washer 38. The conical spring washer 38 is fixed on the end surface of the front stud section 302 by means of a cap screw 39, whose screw shank 391 is passed through the conical spring washer 38 and is screwed into the threaded blind hole 32 in the front stud section 302. In this case, the conical spring washer 38 projects radially beyond the sleeve 36 and presses an elastic disc 40 onto the reflector 11. The two elastic discs 37, 40 are preferably composed of rubber cork.

An acoustically transparent envelope body 41 is placed in front of the front face, facing away from the antenna mount 10, of the reflector 11, which is constructed in this way and is attached to the antenna mount 10, with the transducer arrangement 17 placed in front of it. The envelope body 41 is a layer composite of two outer layers 411 of glass-fibre-reinforced plastic and an intermediate, considerably thicker rubber layer 412 (FIG. 6), and is attached to the two rockers 19, 20. As is illustrated in FIG. 1, the envelope body 41 is fixed at the free end of the rear contact limb 192 of the upper rocker 19 and on the centre section 203 of the lower rocker 20. In both cases, the fixing is in the form of a so-called "sheet pile lock", in which areas which are formed on the rockers 19, 20 and on the envelope body 41 correspondingly engage in one another in an interlocking manner. In the exemplary embodiment illustrated in FIG. 1, a shaped head 42 is formed on each of the rockers 19 and 20 and is clasped by a shell or pan 43 which is formed in the envelope body 41. A cover 44 is also detachably attached to the lower rocker 20, is fixed on the one hand on the envelope body 41 and on the other hand at the free end of the rear contact limb 202 of the lower rocker 20, and closes the U-opening in the rear U-shaped end area of the lower rocker 20. The area which is enclosed by the envelope body 41 with the cover 44 and the antenna mount 10 and in which the reflector 11 is accommodated, together with the transducer arrangement 17 and the rocker system with a buoyant body 21, is flooded.

Figure 5:
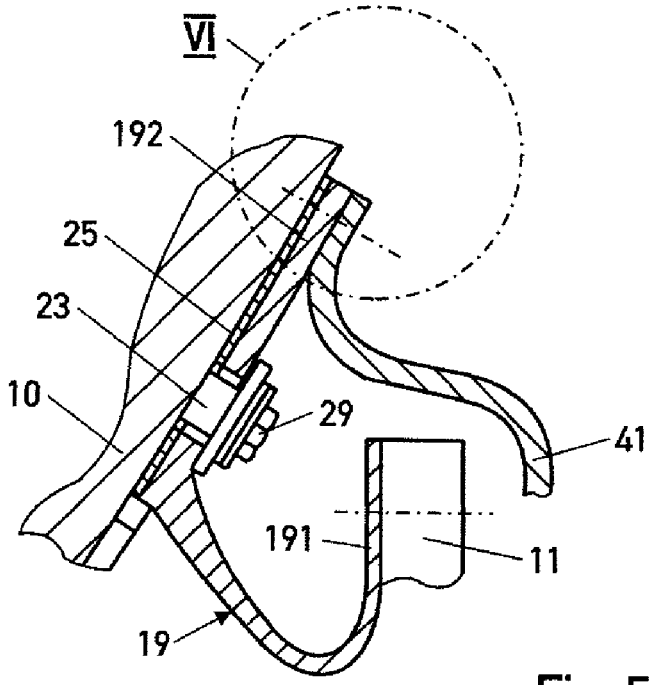
FIG. 5 shows a detail V in FIG. 1 of an underwater antenna that has been modified in this area.

In the detail of the underwater antenna illustrated in FIG. 5, only the attachment of the envelope body 41 to the rockers 19, 20 has been modified. Apart from this, the underwater antenna sketched there corresponds to that described with reference to FIG. 1, as a result of which the same components are provided with the same reference symbols.

Figure 6:
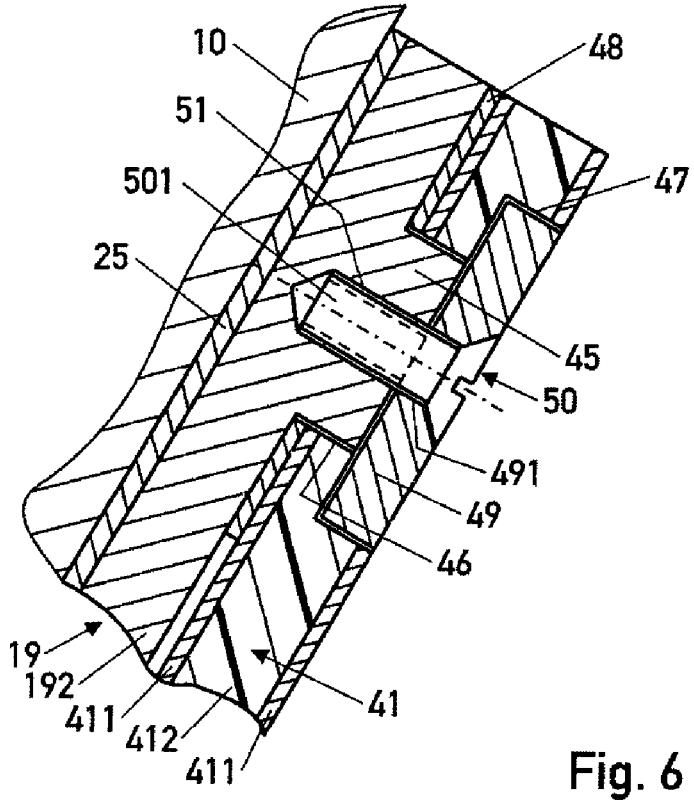
FIG. 6 shows an enlarged detail illustration of the detail VI in FIG. 5.

In the exemplary embodiment shown in FIG. 5, the envelope body 41 is fixed to the rockers 19, 20 by stubs 45 which are integrally formed on the rockers 19, 20 and onto which the envelope body 41 is clipped in an interlocking manner, by a respective recess 46. FIG. 6 illustrates enlarged, and in the form of a section this fixing of the envelope body 41 to the rear contact limb 192 of the upper rocker 19. This attachment applies in the same manner to the fixing of the envelope body 41 to the centre section 203 of the lower rocker 20. The recess 46, which faces the stud 45 and clasps it in an interlocking manner, in the envelope body 41 merges into a coaxial cutout 47 whose diameter is larger, thus resulting in a through-opening with a stepped diameter, being formed in the envelope body 41. An elastic disc 48, preferably composed of rubber cork is pushed over the stud 45, and the envelope body is pressed with the recess 46 in an interlocking manner onto the stud 45, such that the envelope body 41 rests via the elastic disc 48 on the rear contact limb 192 of the upper rocker 19. A conical spring washer 49 composed of metal is inserted in an interlocking manner into the cutout 47 and is provided with a central through-hole 491 with a countersink for the countersunk head of a countersunk headed screw 50. The countersunk headed screw 50, whose screw shank 501 is passed through the through-hole 491, is screwed into a threaded blind hole provided in the stud 45, and thus fixes the conical spring washer 49 on the end surface of the stud 45, with the conical spring washer 49 pressing the envelope body 41 onto the rear contact limb 192 of the upper rocker 19, via the elastic disc 48.

All of the features mentioned in the above description and in the claims can be used according to the invention both individually and in any desired combination with one another. The invention is therefore not restricted to the combinations of features which have been described and claimed. In fact, all combinations of individual features can be regarded as having been disclosed.

What is claimed is:

1. Electroacoustic underwater antenna comprising:

a reflector (11);

spring elements which fix the reflector (11) on an antenna mount (10), in particular on a hull of a submarine, and which act on the reflector (11) close to its upper and lower longitudinal edges in a mounted position of the reflector and a transducer arrangement (17) comprising electroacoustic transducers mounted to the reflector (11), characterized in that the spring elements have an upper and a lower resilient rocker (19, 20), each rocker (19, 20) extending over the horizontal extent of the reflector (11) in the mounted position and having a front contact limb (191, 201) for contacting the reflector (11) and for fixing the spring elements to the reflector (11), and wherein each rocker (19, 20) has a rear contact limb (192, 202) for contacting the antenna mount (10) and for fixing the spring elements to the antenna mount (10), and wherein the upper rocker (19) has an approximately U-shaped profile and the lower rocker (20) has a profile which is formed from two U-shaped end sections, each section comprising only one of the contact limbs (201, 202), and an extended centre section (203) connecting the end sections integrally; and wherein a space between the upper and lower rockers (19, 20) is filled with a buoyant body (21), wherein, on the other hand, the buoyant body (21) extends to the antenna mount (10) and, on the other hand, the body extends to a position spaced from the reflector (11).

2. Underwater antenna according to claim 1, characterized in that the rockers (19, 20) are arranged such that the U-shaped profile of the upper rocker (19) and the U-shaped end sections of the lower rocker (20) face away from one another.

3. Underwater antenna according to claim 1, characterized in that a distance between the buoyant body (21) and the reflector (11) is defined such that the bases of the U-shaped portions comprising the front contact limbs (191, 201) are free of the buoyant body (21).

4. Underwater antenna according to claim 1, characterized in that an elastic film (22) is arranged between the buoyant body (21) and the antenna mount (10), wherein the elastic film covers a contact surface of the buoyant body (21).

5. Underwater antenna according to claim 1, characterized in that the upper and lower rockers (19, 20) rest with their rear contact limbs (192, 202) on the antenna mount (10), wherein an elastic layer (25) is placed between the rear contact limbs (192, 202) and the antenna mount (10), the elastic layer (25) being preferably composed of rubber cork, and wherein the rear contact limbs (192, 202) have at least two elongated holes (24), each elongated hole (24) encompassing a carrier (23) projecting from the antenna mount (10), and wherein a threaded bolt (29) is screwed into each carrier (23) to firmly clamp the rear contact limbs (192, 202) on the antenna mount (10) with a force fit.

6. Underwater antenna according to claim 5, characterized in that a lateral-force disc (26), which rests on the rear contact limb (192, 202) and is preferably composed of glass-fibre-reinforced plastic, is placed largely without any play on each carrier (23), wherein the lateral-force disc (26) has an elastic disc (27) applied to it, the elastic disk (27) being preferably composed of rubber cork, and wherein a metallic conical spring washer (28), preferably a steel disc, covers the elastic disc (27) and is firmly clamped to the threaded bolt (29) on the end surface of the carrier (23), and wherein the conical spring washer (28), projecting radially over the carrier (23), presses an elastic disc (37), preferably composed of rubber cork, onto the lateral-force disc (26).

7. Underwater antennas according to claim 1, characterized in that the reflector (11) is fixed on the front contact limbs (191, 201) of the upper and lower rockers (19, 20) by means of plastic studs (30) which are screwed to the contact limbs (191, 192) and are preferably composed of polyamide, wherein the reflector (11) is pressed on the plastic studs (30) in an interlocking manner and is resiliently attached to the studs (30).

8. Underwater antenna according to claim 7, characterized in that two plastic studs (30) are provided at the maximum distance from each other on each front contact limb (191, 201) of the rockers (19, 20).

9. Underwater antenna according to claim 7, characterized in that each plastic stud (30) has a rear stud section (301) resting on the front contact limb (191, 201), and in that each plastic stud (30) has a front stud section (302) coaxially adjacent to the rear stud section (301) and having a larger external diameter than the rear stud section (301), wherein each stud section (301, 302) has a threaded blind hole (31, 32), which is introduced from its end surface, and wherein a cap screw (33) whose screw shank (331) passes through the front contact limb (191) is screwed into the threaded blind hole (31) in the rear stud section (301) and wherein a cap screw (39) whose screw shank (391) passes through a conical spring washer (38) is screwed into the threaded blind hole (32) in the front stud section (302).

10. Underwater antenna according to claim 9, characterized in that the reflector (11) has a through-channel (35) which is associated with each plastic stud (30) and has a stepped diameter, wherein the channel (35) has a rear channel section (351) having a larger diameter and clasping the rear stud section (301), and wherein the channel (35) has a front channel section (352) surrounding the front stud section (302) at a radial distance, and wherein the channel has a radial shoulder (353) which is formed between the channel sections (351, 352) and rests on the annular end surface of the rear stud section (301) with the interposition of an elastic disc (37), preferably composed of rubber cork, wherein a resilient sleeve (36) is pushed onto the front stud section (302) and is clamped in axially between the end surface of the rear stud section (301) and the conical spring washer (38), and wherein the conical spring washer (38) is fixed by means of the cap screw (39) on the end surface of the front stud section (302) and presses an elastic disc (40), which is pushed onto the sleeve (36), onto the reflector (11).

11. Underwater antenna according to claim 1, characterized in that an acoustically transparent envelope body (41) is placed in front of the reflector (11), on its front face facing away from the antenna mount (10), and wherein the envelope body (41) is fixed to the upper and lower rockers (19, 20).

12. Underwater antenna according to claim 11, characterized in that the envelope body (41) is fixed to the upper rocker (19) at the free end of the rear contact limb (192), and to the lower rocker (20) on its centre section (203).

13. Underwater antenna according to claim 11, characterized in that a cover (44) is arranged on the lower rocker (20) and closes the U-opening in the rear end section of the rocker (20) having the rear contact limb (202), wherein the cover (44) is detachably attached on the one hand to the envelope body (41) and/or to the centre section (203) of the lower rocker (20) and on the other hand to the free end of the rear contact limb (202) of the lower rocker (20).

14. Underwater antenna according to claim 11, characterized in that the envelope body (41) is fixed to each of the rockers (19, 20) in the form of a sheet pile lock in which two mouldings engage in one another in an interlocking manner.

15. Underwater antenna according to claim 11, characterized in that the envelope body (41) is fixed to the rockers (19, 20) by:

studs (45) integrally formed on the rockers (19, 20) wherein the envelope body (41) is clipped to the studs (45) in an interlocking manner by a respective recess (46); and cap screws (50) screwed into the studs (45) and bracing the envelope body (41) on the rocker (19, 20).

16. Underwater antenna according to claim 15, characterized in that an elastic disc (48), which rests on the rockers (19, 20) and is preferably composed of rubber cork, is pushed onto each stud (45) and is used to press the envelope body (41) against the rockers (19, 20) with a force-fit.

17. Underwater antenna according to claim 16, characterized in that each recess (46) in the envelope body (41) merges into a coaxial cutout (47) with a larger unobstructed diameter, and in that a conical spring washer (49) is inserted into each cutout (47), wherein the spring washer (49) clasps the envelope body (41) and is firmly clamped to the end surface of the stud (45) by means of the cap screw (50) which is preferably screwed into a threaded blind hole (51) provided in the stud (45).

* * * * *